US010743680B1

(12) United States Patent
Weis

(10) Patent No.: US 10,743,680 B1
(45) Date of Patent: Aug. 18, 2020

(54) PORTABLE ADVERTISING PLATFORM SYSTEMS

(71) Applicant: Roy John Weis, McMinnville, OR (US)

(72) Inventor: Roy John Weis, McMinnville, OR (US)

( * ) Notice: Subject to any disclaimer, the term of this patent is extended or adjusted under 35 U.S.C. 154(b) by 0 days.

(21) Appl. No.: 16/671,473

(22) Filed: Nov. 1, 2019

(51) Int. Cl.

| | |
|---|---|
| ***A47F 5/00*** | (2006.01) |
| ***A47F 5/10*** | (2006.01) |
| ***A47F 5/13*** | (2006.01) |
| ***G09F 23/06*** | (2006.01) |
| ***A47F 5/14*** | (2006.01) |

(52) U.S. Cl.
CPC ..... *A47F 5/0081* (2013.01); *A47F 5/108* (2013.01); *A47F 5/137* (2013.01); *A47F 5/14* (2013.01); *G09F 23/06* (2013.01); *A47F 5/0006* (2013.01)

(58) Field of Classification Search
CPC ..... A47F 5/0081; A47F 5/108; A47F 5/137; A47F 5/14; A47F 5/0006; G09F 23/06
USPC ..... 211/85.8, 189; 40/590, 606.01–606.03, 40/606.14, 606.17, 610; 280/823
See application file for complete search history.

(56) References Cited

U.S. PATENT DOCUMENTS 516,347 A * 3/1894 Chamberlin ..... A47F 5/10 211/175
623,865 A * 4/1899 Ayer ..... G09B 29/06 40/517
2,720,414 A * 10/1955 Hart ..... B62D 33/08 296/12
2,749,071 A * 6/1956 Remstein ..... F16B 12/40 248/172
2,805,776 A * 9/1957 Levitin ..... A47F 7/30 211/27
2,885,090 A * 5/1959 Forman ..... A47B 45/00 211/175
2,950,015 A * 8/1960 Pataky ..... A47K 10/04 211/182
3,092,408 A * 6/1963 Berman ..... A47F 5/14 403/306
3,149,725 A * 9/1964 Magers ..... A47B 97/02 211/44
3,391,930 A * 7/1968 Weissman ..... A61H 3/04 482/68
3,462,021 A * 8/1969 Hawke ..... A47F 5/14 211/182

(Continued)

*Primary Examiner* — Jonathan Liu
*Assistant Examiner* — Devin K Barnett

(57) ABSTRACT

A portable, aluminum advertising platform system for store front and street side promotions. This rugged, lightweight platform has multiple vertical mounts and substantially stretches both horizontally and vertically providing numerous configurations. Supported signs and products are attached only at the top which allows them to freely swing; wind resistant. The structure is made from 2 aluminum tubes that slide inside each other; telescopes. Fastening occurs using thumb screws attached to the outer tubes that when twisted, pinches the inside interconnecting tubes. Tubes come in 1 to 4 foot lengths and can couple together to form much larger members. The 2 side frames are tubes welded together. The 4 leg levelers telescope 3 feet both horizontally and vertically to level the cart on rough uneven terrain. Levelers also act as durable brakes when any wheels are lifted off the ground. Detachable large 8 inch wheels swivel for easy maneuvering.

13 Claims, 6 Drawing Sheets

(56) References Cited

U.S. PATENT DOCUMENTS 3,608,668 A * 9/1971 Mahaney ..... B66F 11/044 182/2.8
3,702,033 A * 11/1972 Coleman ..... G09F 21/04 40/541
3,812,836 A * 5/1974 Jackson ..... F24C 1/16 126/9 R
3,883,846 A * 5/1975 Bruner ..... B62D 63/064 40/550
3,955,511 A * 5/1976 Bak ..... A47B 45/00 108/137
4,054,209 A * 10/1977 Solomon ..... A47F 7/24 211/208
4,087,785 A * 5/1978 Dodich ..... B60Q 1/305 254/387
4,427,379 A * 1/1984 Duran ..... B62B 3/00 211/182
4,438,580 A * 3/1984 Yamaji ..... G09F 21/048 296/21
4,593,265 A * 6/1986 McKenney ..... E01F 9/662 280/33.998
4,608,773 A * 9/1986 White ..... G09F 15/0075 40/606.01
4,922,653 A * 5/1990 Stone ..... A01G 17/04 47/45
4,959,916 A * 10/1990 Cochrane ..... A47G 1/08 40/603
5,016,893 A * 5/1991 Hart, Jr. ..... B62B 3/10 211/195
5,033,758 A * 7/1991 Levy ..... B62B 3/02 280/35
5,040,808 A * 8/1991 McIntyre ..... B62B 1/18 248/129
5,048,849 A * 9/1991 Mathews ..... B62B 3/10 135/67
5,122,797 A * 6/1992 Wanasz ..... E01F 9/662 340/908
5,143,415 A * 9/1992 Boudah ..... B60R 9/00 224/325
5,190,171 A * 3/1993 Christman, Jr. ... A47B 87/0246 211/186
5,192,107 A * 3/1993 Smith, Sr. ..... B60P 3/40 296/3
5,249,823 A * 10/1993 McCoy ..... B62B 3/02 280/144
5,257,794 A * 11/1993 Nakamura ..... B62B 3/00 211/182
D346,081 S * 4/1994 Turner ..... D6/681.1
5,326,337 A * 7/1994 Pardella ..... A63B 9/00 403/170
D349,668 S * 8/1994 Mathews ..... D12/129
5,476,282 A * 12/1995 Dahl ..... B62B 1/002 280/47.18
D365,716 S * 1/1996 Rose, Sr. ..... D6/552
5,484,150 A * 1/1996 Yasutomi ..... B60B 33/0002 211/182
5,599,031 A * 2/1997 Hodges ..... B62B 5/0083 280/35
5,617,660 A * 4/1997 Pollack ..... G09F 15/0012 40/606.16
5,617,962 A * 4/1997 Chen ..... A47G 25/0664 211/204
D384,464 S * 9/1997 Tonzillo ..... D34/12
D384,979 S * 10/1997 Greene, Jr. ..... D20/41
5,806,905 A * 9/1998 Moore ..... B60R 9/00 296/3
5,820,092 A * 10/1998 Thaler ..... F16M 5/00 248/237
5,862,625 A * 1/1999 Parker ..... A01G 9/12 47/47
5,915,656 A * 6/1999 Grewe ..... G09F 15/0062 248/150
5,918,750 A * 7/1999 Jackson ..... A47F 5/137 108/108
5,971,174 A * 10/1999 Strock ..... A47B 87/008 211/186
6,027,000 A * 2/2000 Sterzel ..... B60R 7/02 211/182
D421,866 S * 3/2000 Long ..... D6/552
6,038,802 A * 3/2000 Tidwell ..... G09F 15/0025 135/127
6,044,990 A * 4/2000 Palmeri ..... A47B 47/0016 211/182
6,109,625 A * 8/2000 Hewitt ..... B60B 33/0007 280/43.24
6,119,384 A * 9/2000 Fischer ..... G09F 21/04 40/590
6,161,320 A * 12/2000 Peterson ..... G09F 15/0025 160/135
6,182,740 B1 * 2/2001 Pfaff ..... A47G 5/00 160/135
6,257,552 B1 * 7/2001 Crow ..... B66F 3/24 254/134
6,536,640 B1 * 3/2003 Gent ..... B60R 9/00 224/403
6,644,484 B1 * 11/2003 Sardis ..... A47B 43/00 211/189
6,659,496 B1 * 12/2003 Wilson ..... B60P 3/0252 280/656
6,694,965 B1 * 2/2004 Chen ..... A47J 37/0704 126/25 A
6,728,980 B1 * 5/2004 Chen ..... A47D 9/02 5/105
6,783,147 B1 * 8/2004 Green, Sr. ..... B62B 1/20 280/47.26
6,786,503 B1 * 9/2004 Young ..... B62B 3/008 280/35
6,889,982 B1 * 5/2005 Gove ..... A63B 63/00 273/343
6,944,981 B1 * 9/2005 Garberg ..... A47F 5/137 186/27
7,017,299 B1 * 3/2006 Speed ..... A01G 9/12 47/21.1
7,037,030 B2 * 5/2006 McLemore ..... E01F 13/048 404/6
7,083,055 B1 * 8/2006 Ambrosat ..... A63B 71/0045 211/85.7
7,341,397 B2 * 3/2008 Murphy ..... B62D 21/20 188/377
D604,473 S * 11/2009 Gibson ..... D34/16
7,866,074 B2 * 1/2011 McComb ..... B43K 23/001 160/135
7,866,679 B1 * 1/2011 Leon ..... B62B 1/264 280/47.131
7,963,530 B1 * 6/2011 Garcia ..... B62B 3/02 280/28
8,011,686 B2 * 9/2011 Chen ..... B62B 3/007 280/651
8,024,881 B2 * 9/2011 Redmon ..... G09F 1/12 40/610
8,149,138 B1 * 4/2012 Burke ..... E01F 13/06 340/908
8,181,796 B2 * 5/2012 DiFazio ..... B65G 65/00 211/41.14
8,328,029 B1 * 12/2012 Binsfeld ..... B66F 7/02 187/240
8,342,544 B1 * 1/2013 Blewett ..... B62B 3/022 211/189
8,827,232 B2 * 9/2014 Crowley ..... A47B 43/003 211/175
9,038,299 B1 * 5/2015 Uribe ..... E01F 13/02 40/610
9,415,786 B1 * 8/2016 Lorrigan ..... B62B 1/206
D777,483 S * 1/2017 Bittle ..... D6/681
D804,764 S * 12/2017 Emery ..... D34/17
D813,787 S * 3/2018 Thomas ..... D12/414
10,525,894 B1 * 1/2020 Williamson ..... B62B 3/007
10,617,069 B2 * 4/2020 MacDonald ..... A01G 17/06

(56) References Cited

U.S. PATENT DOCUMENTS

2002/0005389 A1* 1/2002 Guo ..... B65D 85/185 211/85.3
2002/0084588 A1* 7/2002 Lynch ..... A63B 67/10 273/343
2003/0140538 A1* 7/2003 Garcia ..... G09F 21/04 40/590
2004/0124160 A1* 7/2004 Vitale ..... A47B 47/0016 211/40
2006/0016774 A1* 1/2006 Bustos ..... A47B 57/04 211/186
2006/0168857 A1* 8/2006 Kim ..... G09F 17/00 40/606.01
2006/0185206 A1* 8/2006 Du Bose ..... G09F 7/18 40/610
2006/0283824 A1* 12/2006 Farley ..... F17C 13/085 211/188
2007/0056920 A1* 3/2007 Fleming ..... B25H 3/04 211/85.5
2007/0096437 A1* 5/2007 Watson ..... B62B 5/04 280/651
2007/0131635 A1* 6/2007 Shieh ..... A47B 47/0058 211/204
2007/0220672 A1* 9/2007 Roberts ..... A61G 1/0293 5/81.1 R
2008/0006596 A1* 1/2008 Palmeri ..... A47B 47/0016 211/189
2008/0307684 A1* 12/2008 Ulloa ..... G09F 7/18 40/607.1
2009/0026735 A1* 1/2009 Watzke ..... B62B 1/268 280/652
2009/0184073 A1* 7/2009 Lu ..... A47G 25/0664 211/85.3
2009/0278316 A1* 11/2009 LaMarte ..... A63B 67/06 273/343
2010/0107489 A1* 5/2010 Silver ..... A47B 57/26 47/39
2011/0133417 A1* 6/2011 Rouillard ..... A47L 13/51 280/35
2011/0272543 A1* 11/2011 Wojtowicz ..... A47B 87/0215 248/218.4
2012/0007343 A1* 1/2012 Webster ..... B62B 3/008 280/659
2012/0036751 A1* 2/2012 Wang ..... G09F 7/20 40/600
2012/0097628 A1* 4/2012 Blacknell ..... A47B 45/00 211/85.3
2012/0112425 A1* 5/2012 Hickey ..... B62B 3/10 280/79.3
2012/0153657 A1* 6/2012 Kapoor ..... A61G 3/0858 296/19
2013/0146553 A1* 6/2013 Preidt ..... B62B 3/005 211/153
2013/0306808 A1* 11/2013 Huang ..... A47B 13/06 248/163.1
2014/0083005 A1* 3/2014 Collins ..... F16M 11/32 47/66.6
2014/0345176 A1* 11/2014 Okert ..... G09F 7/22 40/606.03
2014/0353271 A1* 12/2014 Kruse ..... A47F 5/13 211/188
2015/0289652 A1* 10/2015 Strahinic ..... F16M 11/42 211/85.8
2015/0344057 A1* 12/2015 Dehmer ..... B60N 2/2806 280/33.993
2016/0000238 A1* 1/2016 Bruegmann ..... A47F 5/137 211/149
2016/0029786 A1* 2/2016 Davis ..... B60B 33/00 211/85.8
2016/0055447 A1* 2/2016 Sehmer ..... G06K 7/10415 235/385
2017/0295956 A1* 10/2017 Lin ..... A47F 5/14
2018/0025678 A1* 1/2018 Cilliers ..... G09F 23/00 40/610
2019/0223628 A1* 7/2019 Hicks ..... A47F 5/108

* cited by examiner 300
910
650
880

650
950
700
230
800
220
720
210
240
720
200
220
600
850
870
250
650
880
950

800
880
300
910
650

420
870
860
410
460

460
650
480

460
430
480
420
410

650

400

PORTABLE ADVERTISING PLATFORM SYSTEMS

FIELD OF THE INVENTION

This present invention relates generally to both fixed and portable advertising platform systems to support promotional signs, media, retail products, mechanical devices and other items in both outdoor and indoor advertising environments.

BACKGROUND

Businesses, schools and other entities have long employed the use of signs and other media to attract, inform, and/or direct customers, such as by advertising a special promotion or event, providing directions to a specific location, and so forth. One popular technique is to attach signs to portable A-frames and/or sandwich boards and place them by store fronts or on sidewalks next to busy highways in order to draw the attention of both pedestrians and motorists. A big drawback is the ground must be level to minimize falling over. Also, unless anchored, the wind can often blow over such devices. Further, the size of the sign used is limited to the device's display window and most likely is not large enough to display information effectively. Sign visibility is another drawback because these devices display signs at ground level and not at elevated levels where it is easier to engage the attention of passersby. Finally, most such devices are usually carried inside at night so user fatigue and ease of use are drawbacks. Other techniques include using fixed sign frames embedded in the ground and hanging signs from storefronts itself.

Another market application is hanging and displaying retail products such as clothes and plants both inside buildings and outside by the storefronts. One technique is to use wheeled carts that have hanging racks. A big drawback is leveling the cart on uneven ground. Another drawback is the braking mechanism to prevent un-controlled rolling. Most carts have wheels with foot brakes. Such brakes are hard to engage and eventually wear out over time. Maneuverability can be a drawback especially in confined and restricted display areas. Many carts are heavy and have limitations with wheel size plus some of the wheels may not swivel. Other advertising applications include use of electrical signs and mechanical devices requiring access to power sources. They have the same display shortcomings as do signs and retail products.

Therefore, what is needed is an advertising platform that is portable, adjustable, versatile, lightweight, mobile, sturdy and wind resistant and that can easily support and elevate media and products above traffic and over rough terrain and obstacles including ditches and bushes.

SUMMARY

Various embodiments of a portable lightweight advertising platform system for store front, street side and in-door promotions are disclosed herein. The basic embodiment is a platform made from aluminum tubes and is adapted to support signs, media, retail products, electrical signs, mechanical devices and other. This platform consists of a lower cart including a wheel assembly and leg levelers supporting an upper web that can have multiple tiers and overhanging arms. All hung items are fastened at their tops only allowing them to freely swing; wind resistant. Double sided versions of the hung items can be used for viewing from opposite directions. The cart can stretch several feet horizontally both in length and width from a compressed configuration for use in a narrow confined area to a wide configuration for use in open space. The upper web stretches horizontally to match that of the cart and can also stretch several feet vertically to elevate signs and other items above obstacles such as bushes.

Each corner of the cart has a leg leveler that can telescope 3 feet horizontally and 3 feet vertically to level the cart on rough uneven terrain and over ditches. This telescoping range can be increased by using longer insert tubes. Levelers also act as durable brakes when any wheels are lifted off the ground. With no wheel brakes required, there is good clearance between the wheel flange and wheel itself providing an easy to clean and mud resistant feature. The large 8 inch wheels all swivel for easy maneuvering over rough terrain and in confined areas. Being easily detachable, smaller wheels can be swapped out for indoor applications and much larger wheels for outdoors.

The platform's core brace members consist of 2 smaller aluminum insert tubes that slide inside a larger aluminum host tube. Attached to both ends of the host tube are thumb screws and when twisted, press against and pinch the insert tubes to produce a snug, secure fasten. All connecting joints and the cart's 2 side frames are made from the same large host tube and include thumb screws for fastening. To make more rugged, some slop or spacing between the tubes is designed in, so if dirty or damaged, the insert tubes may still slide and still be snuggly fastened using the thumb screws.

All the brace members can telescope or stretch up to the point where the not-to-exceed markings stamped onto the insert tubes, have become visible. If stretched beyond the markings, the insert tube may slide too far and the thumb screw could miss it. The overall length of the brace members can also be changed by connecting additional host and insert tubes and by providing tubes of different lengths, such as in 1, 2, 3 and 4 foot increments. Both the cart and upper web use this tube stretching methodology. Additionally, the width of the cart can be doubled and then stretched by connecting extra side frames. Extra wheel assemblies can then be optionally added. Furnishing extra tubes, having tubes of varying lengths, connecting extra side frames, combined with the telescoping capabilities, provides an extensive range of platform configurations including a store front version that can roll under doors for message set up after hours.

The platform, being made from aluminum tubes, is sturdy, rugged, rust proof, lightweight and weighs about 40 pounds without the wheels. The weight depends on the configuration and components used. It has a display and storage capacity of about 300 pounds; 400 and more if reinforced components are used. It can easily be disassembled for storage by simply un-twisting the thumb screws. In some embodiments, other fastening mechanisms or combinations thereof may be employed including snap buttons, and bolts with wing nuts. In other embodiments, alternate tube sizes, wall thicknesses, and tube dimensions may be optionally used. In some embodiments, other materials such as composites and plastics might be used instead of aluminum. In other embodiments, the platform's components and members may be coated with a reflective paint or powder coat where the reflection and bright colors can help gain the attention of passersby. In some embodiments, the platform may be modified to carry a portable power supply to power any electronics associated with signs, mechanical devices or retail products.

BRIEF DESCRIPTION OF THE DRAWINGS

The concepts, features, methods, and component configurations briefly described above are clarified with reference to the accompanying drawings and following detailed descriptions. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the inventions.

DETAILED DESCRIPTION OF THE DRAWINGS

In the following paragraphs, the present embodiments will be described in detail by way of example with reference to the attached drawings. Throughout this description, the preferred embodiment and examples shown should be considered as exemplars, rather than as limitations on the present embodiments.

Figure 1:
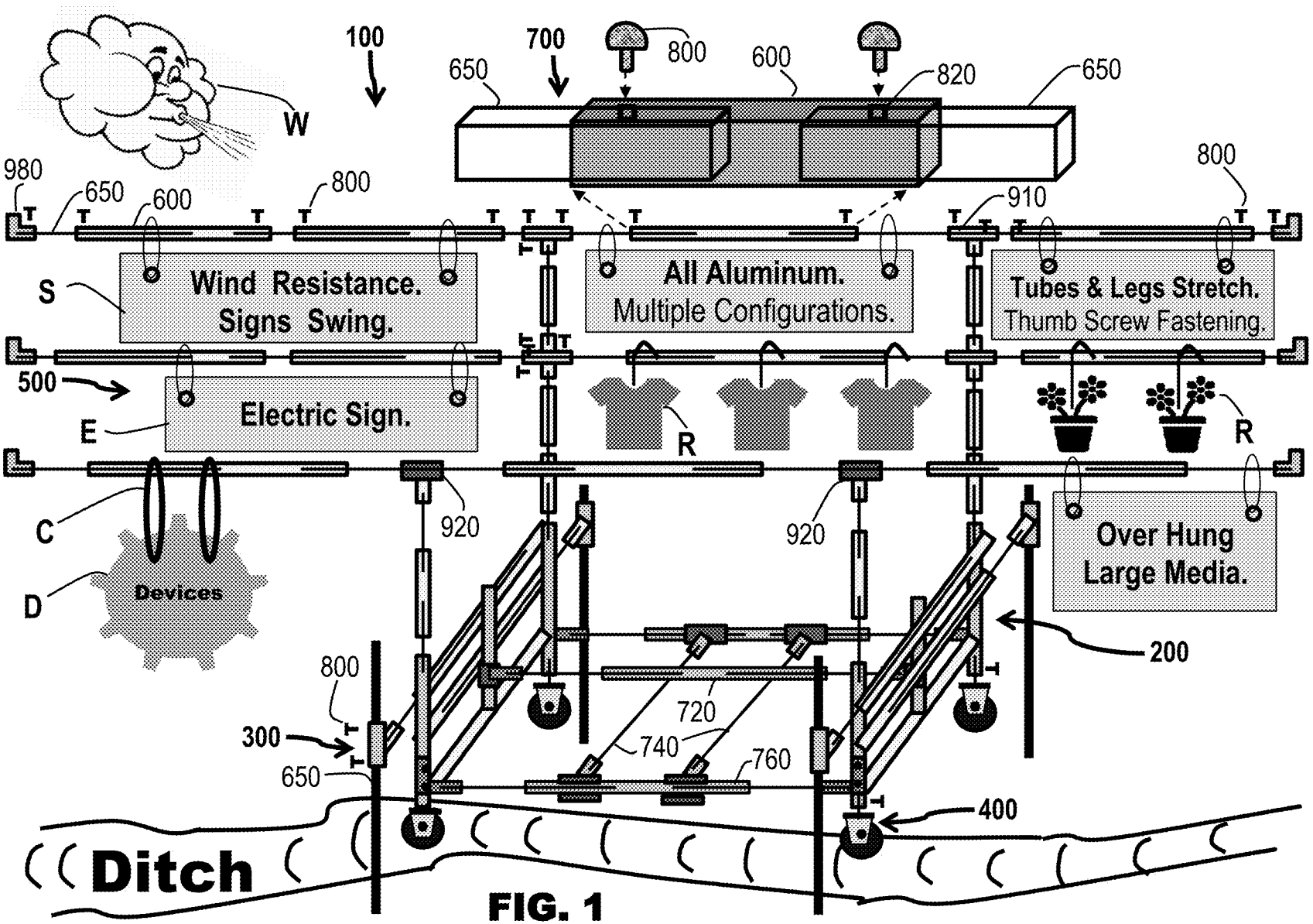
FIG. 1 is an elevation view of an example embodiment of the aluminum advertising platform that stretches substantially both horizontally and vertically. The platform consists of a lower cart supporting an upper web. The 4 leg levelers telescope 3 feet both horizontally and vertically to level the cart on uneven terrain. Levelers also act as sturdy brakes. Detachable large 8 inch wheels swivel for easy maneuvering. All supported signs and products are attached only at their tops which allow them to freely swing; wind resistant. Additional tiers and overhanging arms can be added to the top of the web. Shown at the top of FIG. 1 is an expanded view of the core brace member made from 2 aluminum tubes that slide inside each other; telescopes. Thumb screws are used as fasteners. Tubes come in 1, 2, 3 and 4 foot lengths and can couple together.

FIG. 1 illustrates an embodiment of the aluminum advertising platform 100 having an adjustable upper vertical web 500 mounted on top of a cart 200 with a wheel assembly 400 and a retractable leg leveler assembly 300. All media, devices and retail products are fastened only loosely at the top of web 500 so they can freely swing with the wind W minimizing aerodynamic forces. Brace member 700 shown at the top of FIG. 1 illustrates the core structural methodology which is based around 2 aluminum tubes that slide inside each other allowing web 500 to stretch or telescope both vertically and horizontally. Thumb screws are used as an easy-to-use secure fastening mechanism.

Figure 6:
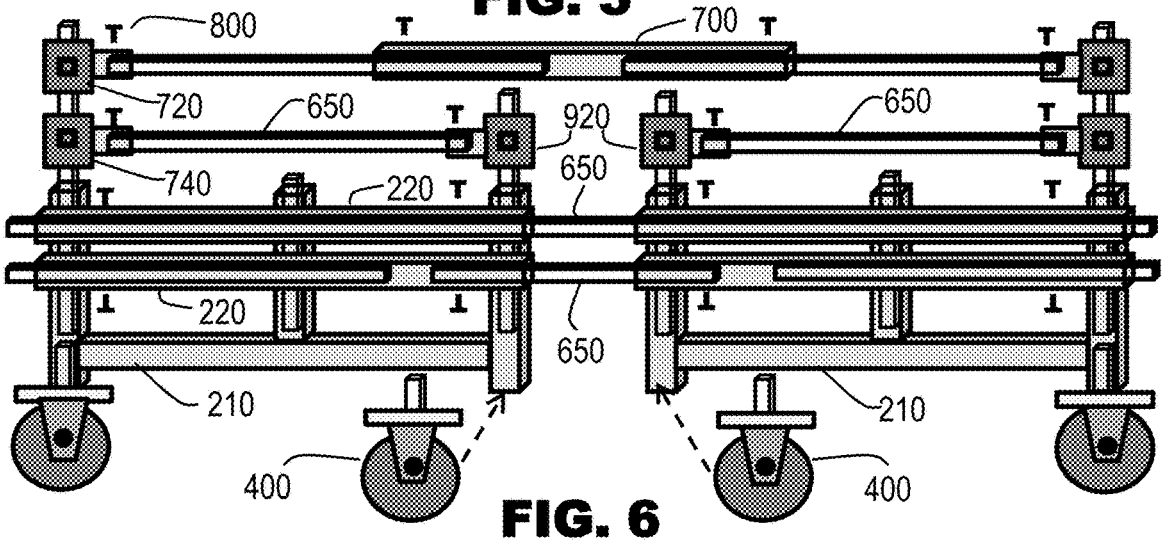
FIG. 6 is a side view of an extra side frame configuration shown in FIG. 11. Shown at the top is "U" joint cross braces to reinforce the upper web vertical extensions of the platform in FIG. 1.
Figure 11:
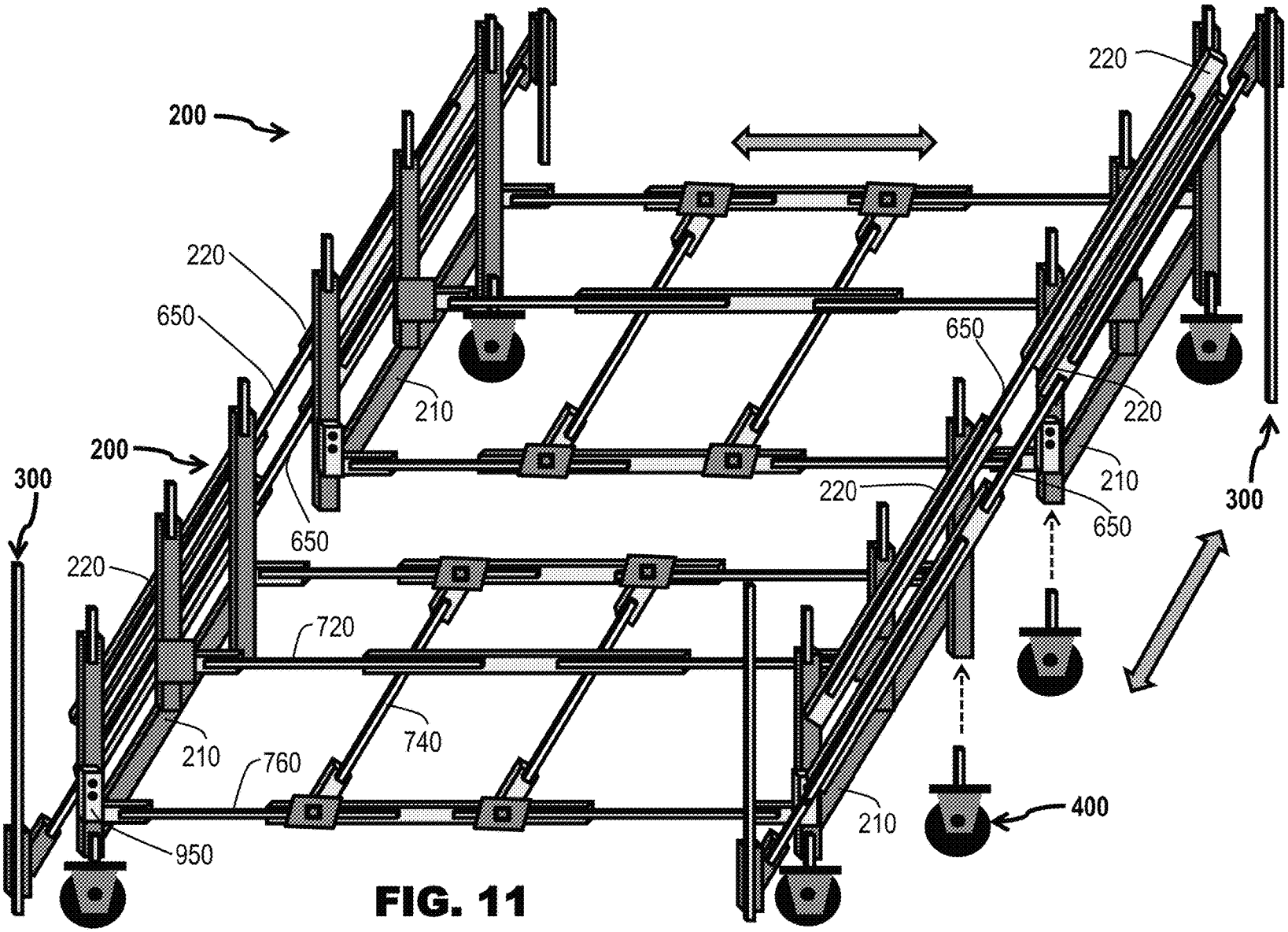
FIG. 11 is a front view that shows connecting an extra side frame to double the envelope size of the platform's cart plus adding extra optional wheel assemblies.

The cart 200 can also stretch several feet horizontally in the length axis plus has 3 vertical mounting positions to anchor the upper web providing numerous configurations including a store front version that rolls under doors for set up indoors after hours. In a different embodiment and as shown in FIGS. 6 and 11, extra side frames can be connected to at least double the width of cart 200. The width can be further stretched using the same telescoping methodology as in web 500. If desired, extra wheel assemblies 400 can then be used creating a 6 or 8 wheeled reinforced cart 200.

The four leg levelers 300 can stretch 3 feet both vertically and horizontally providing the ability to level the entire platform 100 on the most uneven terrain including over ditches. To operate leg leveler 300, the user lifts the cart until level, then un-twists the thumb screws 800 allowing the smaller insert tubes 650 to freely drop to the ground. The user then twists the thumb screws 800 to fasten. These leg levelers 300 also act as sturdy and durable brakes after one or all of the 4 wheels are lifted off the ground. For indoor use, plastic tube inserts can be placed in the levelers to minimize scratching of floors. The wheels in assembly 400 are 8-inch diameter, have no brakes, are mud resistant, and can swivel 360 degrees for easy maneuvering especially in confined areas. Because assembly 400 is thumb screw attached, the wheels can easily be swapped out with smaller and larger sizes using standard stocked items in local stores.

As shown in FIG. 1, platform 100 can support a variety of retail products R such as clothes and plants plus a variety of media and signs S including double sided versions for viewing in opposite traffic directions. Electric signs E and mechanical devices D including batteries can also be displayed. Except for the wheels, fasteners and connectors C, all of platform 100's components are aluminum, providing a sturdy, stable, and lightweight platform. Platform 100 without the wheels, weighs about 40 pounds depending on the configuration and components used. If desired, bricks can be used as anchors. Platform 100 has a display capacity of about 300 pounds; 400 and more if reinforced components are used. In other embodiments, heavier hanging loads can be supported by using additional braces and aluminum tubes with a thicker wall thickness.

Figure 2A:
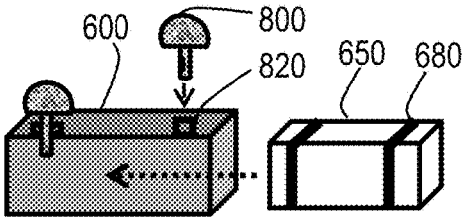
FIG. 2A illustrates the two types of tubes used in the FIG. 1 platform and the thumb screw fastening mechanism. Also shown are the "not-to-exceed" markings when telescoping or stretching the tubes.
Figure 2B:
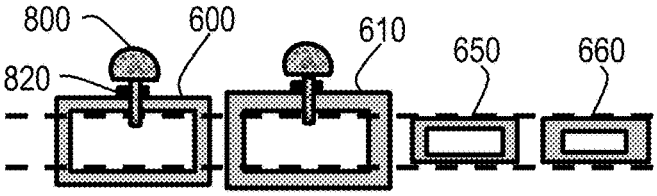
FIG. 2B is a side view of the 2 tubes shown in FIG. 2A plus optional heavy duty tubes with a thicker tube wall.

FIGS. 2A and 2B illustrate the two sizes of aluminum tubes used, the thumb screw fastening mechanism and the "not to exceed" markings when assembling. The smaller insert tube 650 slides inside the larger host tube 600. An aluminum nut 820 is welded to both ends of host tube 600 plus all the joints shown in FIG. 5. Nut 820 is also welded in selected areas on side frame 210 shown in FIG. 8. These nuts 820 are centered on a hole (not shown) into which is received a threaded thumb screw 800 or fin bolt. As the thumb screw 800 is twisted, it presses against and pinches insert tube 650. This pinching action provides a secure and snug, fastening mechanism. The pinching positions are continuous providing a wide range of telescoping. Embedded on both ends of insert tube 650 are "not-to-exceed" telescoping markings 680. If during assembly of platform 100 a marking 680 becomes visible, it informs the user not to stretch or telescope any further. If stretched beyond the markings, the insert tube 650 may have slid too far and the thumb screw could miss it. All thumb screws 800 and corresponding nuts 820 are located 2 inches from the end of host tube 600 and every connecting joint's branches. The 680 markings are located 3 inches from both ends of insert tube 650. The net effect is a 1-inch overlap buffer is created for thumb screw engagement. In some embodiments, other fastening mechanisms, or combinations of other fastening mechanisms, may be used including snap buttons, bolts with wing nuts, and so forth.

Figure 3:
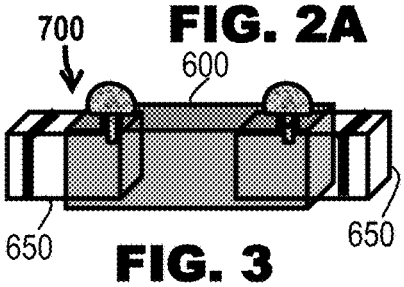
FIG. 3 illustrates the core brace member that is used in the platform shown in FIG. 1.

FIG. 2B is a side view of the aluminum tubes 600 and 650 shown in FIG. 2A. The larger host tube 600 has a rectangular cross section of 1"×1.5" with a wall thickness of 0.045". Host tube 600 is also used in fabricating all the connecting joints shown in FIG. 5 plus cart side frame 210 shown in FIGS. 6, 7, 8, and 11. Smaller insert tube 650 has a rectangular cross section of 0.87"×1.37" and a wall thickness of 0.045". The combined effective wall thickness and associated strength is essentially doubled to 0.090" when core brace member 700 in FIG. 3 is fully compressed. In other embodiments, the tube strength can be further increased by using tubes with a heftier wall thickness. As shown in FIG. 2B, tube 610 with a thicker wall, substitutes for host tube 600 while tube 660 with a thicker wall, substitutes for insert tube 650.

Insert tube 650 easily slides inside host tube 600, side frame 210 and all the joints. Insert tube 650 is also welded to the flange plate 480 in wheel insert 460 shown in FIG. 10C. As illustrated by the dashed lines in FIG. 2B, there is some designed in slop or space between tubes 600 and 650 so if any become dirty or damaged, insert tube 650 can still slide and be snuggly fastened to host tube 600 using the thumb screw mechanism. In some embodiments, other materials such as composites and plastics might be used instead of aluminum. In other embodiments, the aluminum tube sizes, dimensions, and wall thickness may change but the concept of one tube sliding inside the other remains the same.

Figure 4:
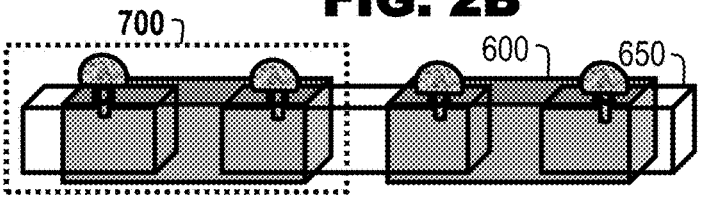
FIG. 4 illustrates connecting additional tubes to the core brace member in FIG. 3 to form a much larger brace member.

Shown in FIG. 3 is core brace member 700 which is used in most of the members in upper web 500 and cart 200. Core brace 700 is comprised of one host tube 600 and two insert tubes 650 that protrude from both ends of host tube 600. As shown in FIG. 4, these protruding insert tubes 650 can then interconnect with additional tubes 600 and 650 to form much larger members. In the basic embodiment, both tubes 600 and 650 will come in 1, 2, 3 and 4 foot lengths and multiple quantities with all included in a customer kit. This combination of tube lengths and quantities plus the telescoping capabilities provides an extensive range of platform 100 configurations. In other embodiments, different tube lengths and quantities can be offered for tubes 600 and 650.

Figure 5:
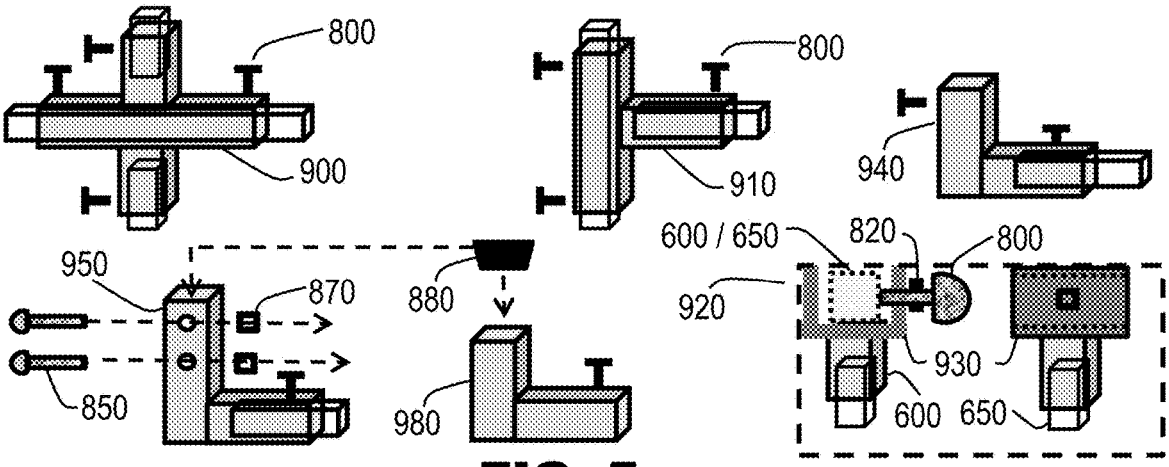
FIG. 5 is oblique views of the 6 connecting joints used in the FIG. 1 platform.
Figure 7:
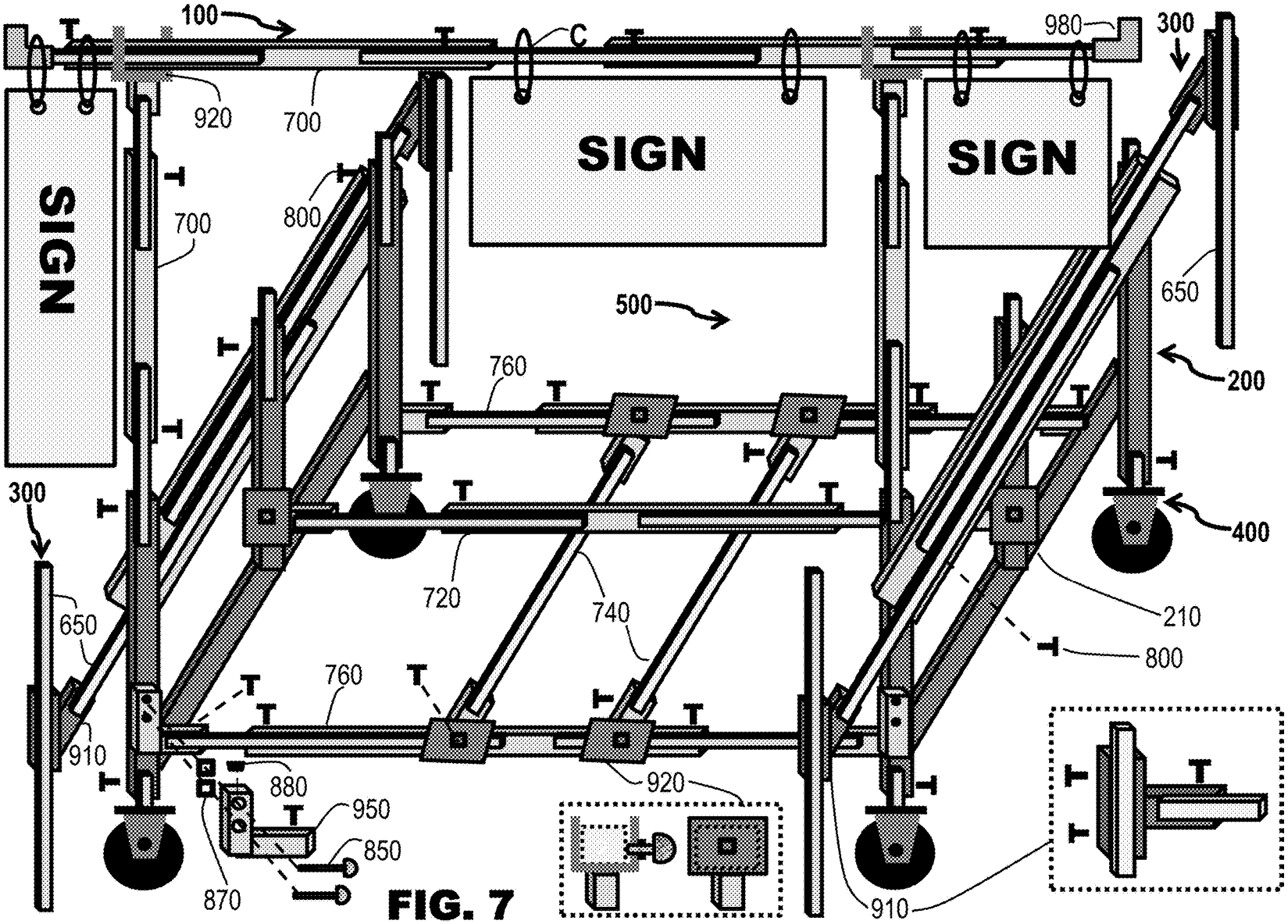
FIG. 7 is an expanded front view of the platform's cart in FIG. 1 including close up views of the "U" joints, "T" joints, and bolt-on cross brace joints.
Figures 8, 9A, 9B, 10A, 10B, 10C, 10D:
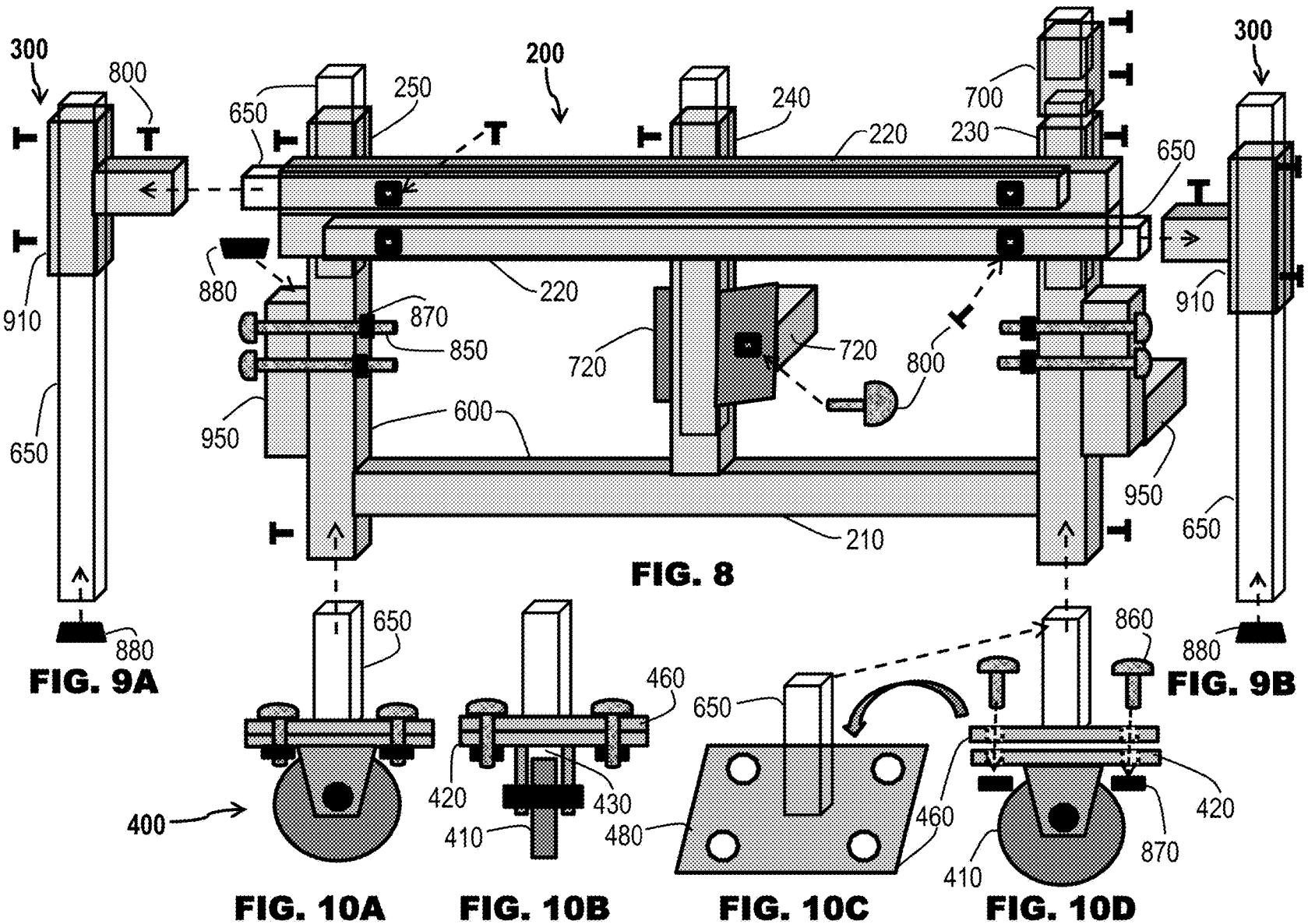
FIG. 8 is an expanded view of the cart's side frame shown in FIG. 1.
FIGS. 9A and 9B are oblique views of the leg levelers shown in FIG. 1.
FIGS. 10A, 10B, 10C and 10D are oblique, partial views of the wheel assemblies shown in FIG. 1.

FIG. 5 is a close-up, perspective view of the 6 connecting joints used in upper web 500, cart 200 and leg levelers 300. These joints are fabricated from larger host tube 600 through which smaller insert tubes 650 slide within. Thumb screws 800 attached to these joints, provide a snug, secure fasten. Cross joint 900 is used for multiple tiers and overhanging members in web 500. "T" joint 910 is used in a multi-tier web 500 configuration plus in all leg levelers 300. Elbow 940 is optionally used on the top of the upper tier as a substitute for "U" joint 920. As shown in FIGS. 7, 8, and 11, joint 950 is used to bolt horizontal cross supports 760 to cart side frames 210. Joint 980 helps to prevent supported items from sliding off any overhanging members. Plastic insert 880 is pressed into joints 950 and 980 to cap them from dirt and moisture. "U" joint 920 is used on the top of the upper tier in web 500 plus in cross braces 720 and 740 shown in FIGS. 6, 7 and 11. "U" joint 920 is made from a 3 inch long aluminum channel 930 that is welded to host tube 600. Channel 930 has a 2 inch by 2 inch cross section. Tubes 600 and 650 sit inside channel 930 and are fastened using thumb screw 800 attached to channel 930.

Shown at the top of FIG. 6 are cross braces 720 and 740. Brace 740 consists of 2"U" joints 920 that are connected by a single insert tube 650. The host tube 600 in joint 920 provides some space for insert tube 650 to initially slide inside joint 920 and then be positioned for easy attachment using the joint's thumb screws. As shown in FIG. 6, cross brace 740 can be used to reinforce the vertical assemblies extending from cart side frame 210. Cross brace 740 can also reinforce other cross brace assemblies. Cross brace 720 consists of 2"U" joints 920 that are connected by core brace member 700 shown in FIG. 3. As shown in FIGS. 7 and 11, one or more cross braces 720 can be used to reinforce horizontal cross supports 760. Similarly, cross brace 720 can be used as added support in upper web 500.

In a different embodiment and as shown in FIGS. 6 and 11, extra side frames 210 can be connected to at least double the width of cart 200 plus increasing the vertical mounts from 3 to 6. FIG. 11 is an expanded front view of this extra side frame configuration with FIG. 6 showing the side view. To connect the extra side frames, insert one or more tubes 650 into leg leveler mounts 220 and fasten using thumb screws 800. The preferred approach is to use only one mount 220 for connection and leaving the other mount for leg leveling. The width of cart 200 can be further increased by widening the gap between the side frames 210 by telescoping the tubes 650. If desired, extra wheel assemblies 400 can be used creating a 6 or 8 wheeled reinforced cart 200. Wheel assemblies 400 have a limited telescoping capability using thumb screws 800 so all the wheels can be leveled when rolling the platform.

Figure 17:
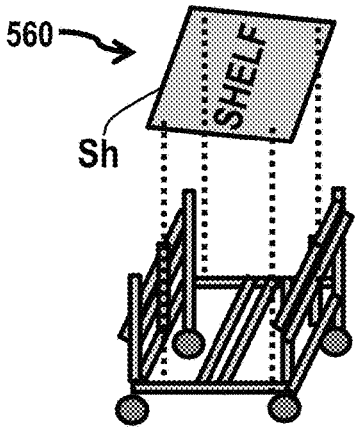
FIG. 17 illustrates attaching an aluminum sheet metal cover to create a shelf.

For the basic embodiment, FIG. 7 is an expanded front diagonal view of platform 100 and is used to illustrate assembly and telescoping. To assemble, Step 1 is to fasten joints 950 to side frames 210 using bolts 850 and lock nuts 870. Step 2 is to stretch core brace member 700 to the desired horizontal length and then insert into joints 950 to connect the 2 side frames 210; fasten with thumb screws 800. This combination of core brace 700 and joints 950 forms horizontal cross supports 760. If needed, longer tubes plus extra tubes can be added to core brace member 700 to make a much longer support 760 to substantially increase the horizontal length of cart 200. Step 3 is fastening one or more cross braces 740 between the 2 horizontal cross supports 760 to reinforce the structure plus create a frame for a shelf. In a different embodiment and though functionally not required, some modules made from aluminum sheet metal can be optionally offered as a shelf cover Sh as illustrated in FIG. 17. Step 4, if desired, is to attach one or more cross braces 720 between the 2 side frames 210 to horizontally strengthen cart 200. Cart 200 is now assembled.

Step 5 in assembling platform 100 is to attach the upper web 500 to cart 200. To start, stretch another core brace member 700 to the desired vertical height and then as shown in FIG. 8, insert one end into the front, middle or back vertical mounts 230, 240, and 250 on side frames 210. Fasten using the thumb screws 800 on side frames 210. Then attach the appropriate connection joint to the top end of this core brace member 700. Step 6 is to stretch another core brace member 700 to the desired horizontal length and then attach to the connection joints. This squares up web 500 which further strengthens the entire platform 100.

Figure 14:
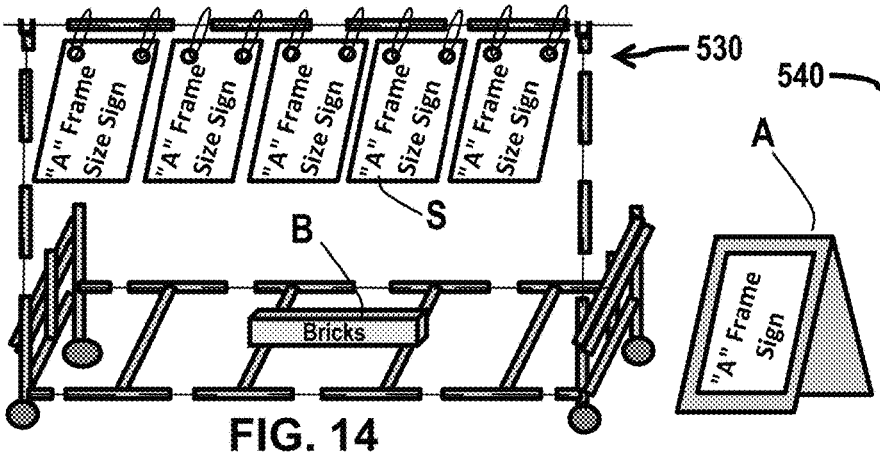
FIG. 14 illustrates a substantially stretched configuration to handle many elevated signs mounted at the front. Bricks can optionally be used as anchors. A typical competitive "A" frame or sandwich board provides some scale to compare.

The upper web 500 can take on a variety of configurations using combinations of multiple mounts, joints, braces and tube assemblies. To add several more tiers, cross joint 900 is used. For a squared look, use both the front and back vertical mounts 230 and 250 on cart 210 and then reinforce with brace 740 as illustrated in FIG. 6. For overhanging members and as shown in FIG. 7, "U" joint 920 is used. As shown in FIG. 14, platform 100 can be optionally anchored by placing bricks B on the frame of cart 200.

FIGS. 8, 9A, 9B, 10A, 10B, 10C and 10D are expanded perspective views of cart 200's side frame 210, leg levelers 300 and wheel assemblies 400. As shown in FIG. 8, side frame 210 is fabricated using larger host tubes 600. Welded to side frame 210 are 2 horizontal mounting tubes 220 made from larger host tube 600. These 2 tubes 220 are used to mount leg levelers 300 to side frame 210. Also shown are the bolt-on joints 950 which are used as part of horizontal cross support 760 to interconnect the 2 side frames 210. Shown at the top of FIG. 8 are front vertical mount 230, middle mount 240 and back mount 250. Attached to these mounts are thumb screws 800 for fastening. Shown just below middle vertical mount 240 and tubes 220 is horizontal cross brace 720 for use as an optional horizontal support. If desired, extra cross braces 720 can be used.

As shown in FIGS. 9A and 9B, the leg levelers 300 consist of insert tubes 650 that slide into both the vertical and horizontal branches of joints 910. Step 1 in operating leg leveler 300 is to insert one end of tube 650 into the horizontal branch of joint 910 and fasten using thumb screw 800. Then insert the other end of tube 650 into the leg leveler mounting tube 220 welded to side frame 210. Then slide tube 650 to the desired horizontal width and fasten using thumb screw 800 attached to mounting tube 220. Repeat this procedure for all four legs.

Step 2 is for the user to simply lift one side of cart 200 until level, and then un-twist the thumb screws 800 on that side's 2 leg levelers 300 allowing the vertical insert tubes 650 for both levelers to freely drop to the ground. Then twist the thumb screws 800 to secure and fasten. Step 3 is repeating step 2 on the opposite side of cart 200. Step 4 if necessary, is fine tuning adjustments on all 4 leg levelers 300. Because the entire platform 100 is lightweight, the effort required by the user to lift each side of cart 200 is minimal. With the leg levelers 300 being able to stretch several feet both vertically and horizontally, provides the capability to level platform 100 on the most uneven terrain and over obstacles such as ditches and bushes. In the basic embodiment, the largest insert tube 650 is 4 feet providing a vertical leg leveler 300 telescoping range of 3 feet. Similarly, the leg leveler 300 horizontal range is 6 feet; 3 feet each leg. To change the telescoping ranges, simply swap with larger or smaller insert tubes 650 and/or core brace member 700.

These leg levelers 300 also act as brakes when one or more wheel assemblies 400 are lifted off the ground. The brake mechanism is the friction between the levelers' insert tubes 650 and the ground. This mechanism is far more effective than wheel brakes which can clog, slip and fail with extended usage; safety issues with possible uncontrolled rolling. Wheel brakes also have to be set by a person's foot which can be difficult and cumbersome. The leg levelers 300 are very durable because any dirty or damaged tubes can still be used because of the built in slop between the large host tubes and smaller insert tubes. The levelers are also easy to clean and if desired, easily replaced. For indoor use, plastic tube inserts 880 can be pressed into the vertical insert tubes 650 to minimize scratching of floors. In a different embodiment and as shown in FIG. 2B, the strength of the leg levelers 300 can be increased by substituting insert tubes 650 with tubes 660 which have a thicker wall thickness. To further increase strength, thicker walled tubing can be used for leg leveler mounting tubes 220 and joint 910.

FIG. 10A shows a completed wheel assembly 400 and FIG. 10B shows the side view. As shown in FIG. 10B, wheel 410 has a diameter of 8-inches and can swivel 360 degrees for easy maneuvering especially in confined areas. Wheel 410 has no brakes, comes attached to a flange 420 where the space 430 between them is considerable making the assembly more mud resistant, subject to less ware and easier to clean. As shown in FIG. 10C, wheel insert 460 consists of insert tube 650 welded to flange 480 made from aluminum bar stock. Flange 480 has a drilled hole pattern to match that on wheel flange 420. As shown in FIG. 10D, bolts 860 and lock nuts 870 are used to fasten wheel insert 460 to wheel flange 420 to make wheel assembly 400. The protruding insert tube 650 on wheel assembly 400 then slides inside the underside of frame 210 and is then secured using thumb screw 800. By using thumb screws, the wheel assemblies have a limited telescoping capability to level the cart for rolling. With assembly 400 being easily detachable, a variety of wheel sizes can be swapped out by the user including smaller sizes for a storefront application and larger sizes for traversing over rough terrain.

Figure 12:
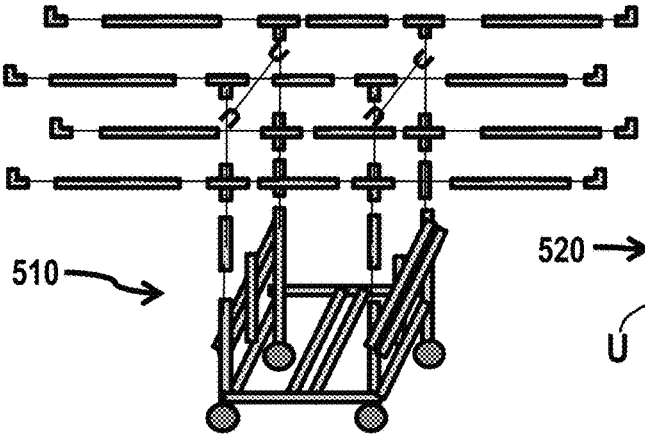
FIG. 12 illustrates one platform configuration with two squared tiers and overhanging arms using the cart's front and back mounting tubes.
Figure 13:
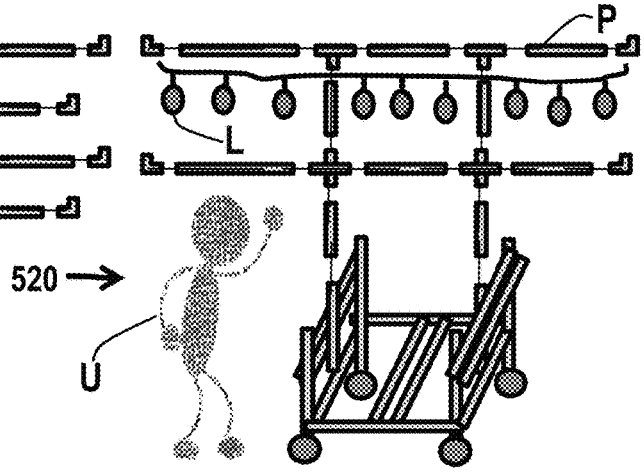
FIG. 13 illustrates one platform configuration using the center mounting tubes to support two single tiers in the upper web. Woven light strings and reflective bright paint on the upper tier helps to attract attention of passersby. The user can easily maneuver the platform to the optimal promotional position.

FIGS. 12-17 illustrate the capabilities and samplings of numerous configurations of platform 100. Not shown is platform 100's capability of using double sided signs and media for simultaneous viewing in opposite directions. FIG. 12 illustrates configuration 510 with two squared tiers and overlapping arms using cart 210's front and back mounts 230 and 250. One application is displaying retail products such as clothes on all sides of configuration 510. FIG. 13 illustrates configuration 520 using center mounts 240 to support two single tiers in upper web 500. The user U can easily maneuver the platform to the optimal promotional position. Lights and/or light strings L can be wrapped around upper web 500 to illuminate platform 100. In another embodiment and as shown in FIG. 13, all of platform 100's components can be coated with a reflective paint P or powder coating where the reflection and bright colors can help to gain the attention of passersby.

Figure 15:
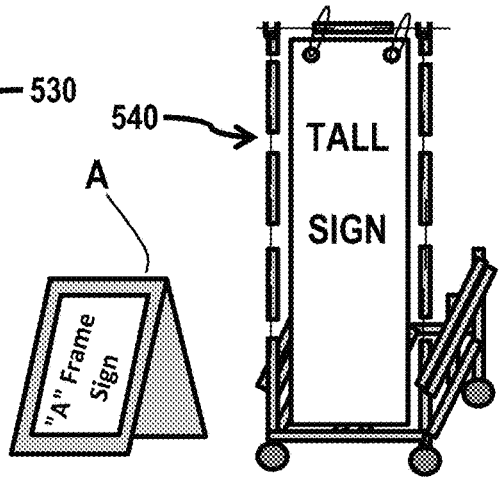
FIG. 15 illustrates a compact configuration for use in a limited display area.

FIG. 14 illustrates a substantially stretched horizontal configuration 530 using front mount 230 to display many signs S at an eye level elevated position. Bricks B can optionally be used as anchors. A typical competitive "A" frame A or sandwich board provides some scale to compare. Besides having a much larger display area than frame A, platform 100 can easily be maneuvered while frame A has to be carried by user U. Another frame A limitation is level ground is needed to prevent falling over especially by wind. In comparison, platform 100 is wind resistant and can be leveled on the most uneven terrain using leg levelers 300. FIG. 15 shows a compact configuration 540 for use in a confined display area but with sufficient air space to hang a narrow but tall sign.

Figure 16:
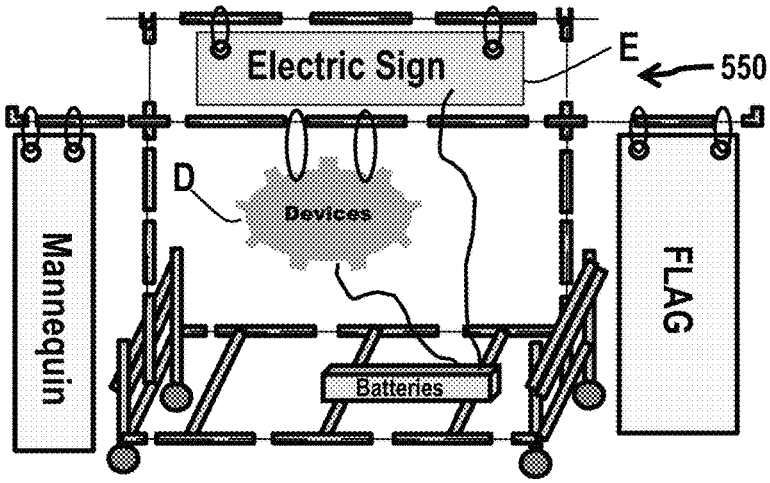
FIG. 16 illustrates a stretched configuration displaying a variety of media including electric sign, mechanical device, mannequin and flag. Batteries can easily be placed on the cart's cross braces.

FIG. 16 shows a stretched configuration 550 using center mount 240 to display electric sign E, mechanical device D plus mannequins and flags. Batteries can easily be placed on cart 200's cross braces 760 and 740. In a different embodiment, configuration 560 in FIG. 17 illustrates attaching an optional aluminum sheet metal module Sh for use as a shelf cover. In other embodiments, customers may opt to fasten their own shelf covers made from plywood, corrugated board or other.

All signs, media, devices and retail products are fastened only loosely at the top of upper web 500 so they can freely swing with the wind W minimizing aerodynamic forces. Attachment connectors C include zip-ties, cords, clips and so forth. The preferred material for signs S should be rigid, lightweight, and weather-proof such as laminated board and corrugated plastic. A reflective sign surface such as using reflective paint helps in gaining the attention of passersby.

All though not required to all embodiments, platform 100 is of multi-piece construction with few parts and most being common. This may result in lower manufacturing and storage cost. Further, providing platform 100 components in a compact customer kit to be assembled by a user may reduce shipping costs. Also, custom reader boards may be offered that include grommets for easy attachment to platform 100. These boards have grommets on all four corners so that they can be connected with other reader boards to increase overall sign size. All platform components and reader boards nest well in the same shipping container that meets requirements for inexpensive air freight with home delivery.

It will be apparent to those skilled in the art that various changes in form and detail may be made to the present invention without departing from the spirit and scope of the invention. The present invention is intended to embrace all such alternatives, modifications and variances that fall within the scope of the appended claims.

I claim:

1. A modular and portable advertising platform system to support indicia-bearing media, retail products, mechanical devices and other items with the platform system comprising:

a generally rectangular cart comprising a front, a rear, opposite sides, a plurality of vertical mounts, a plurality of horizontal brace members, and a plurality of first horizontal insert tubes that telescopically attach to each horizontal brace member so that the cart is adjustable both in width and in length, wherein ends of corresponding first horizontal insert tubes slide inside corresponding first interconnecting joints that are attached to corresponding vertical mounts;

detachable wheel assemblies that are telescopically coupled to corresponding vertical mounts at four corners of the cart to level the cart in preparation for rolling and wherein each wheel assembly can be optionally replaced with a smaller wheel for indoor use and a larger wheel for rough terrain;

leg levelers coupled to corresponding horizontal brace members at a front end and a rear end of the cart respectively, wherein each leg leveler comprises a first vertical insert tube, a second horizontal insert tube, and a second interconnecting joint, wherein the leg levelers are slidably adjustable both vertically and horizontally to level the platform system on an uneven ground surface and wherein by using friction with the ground surface can provide a durable brake mechanism after the wheels assemblies are lifted off the ground surface, wherein the leg levelers extend beyond the front end and the rear end of the cart; and at least one upper web comprising a plurality vertical brace members, a plurality of second vertical insert tubes telescopically attached to the plurality of vertical brace members, multiple tiers of horizontally telescopic overhanging arms that extend beyond each side of the cart, and a plurality of third interconnecting joints, wherein the horizontally telescopic overhanging arms are constructed from tubes which provide the mounting sites for the indicia-bearing media, retail products and mechanical devices, and wherein each upper web is vertically adjustable by the vertical brace members, the second vertical insert tubes, and the third interconnecting joints which are interconnected; and each upper web is horizontally adjustable by the telescopic overhanging arms that are attached to the third interconnecting joints.

2. The platform system of claim 1, wherein each brace member comprises a aluminum host tube, wherein each insert tube is an aluminum insert tube that slides inside corresponding host tubes respectively.

3. The platform system of claim 1, wherein each brace member includes a fastening mechanism comprising thumb screws inserted within each host tube adjacent to opposing ends of each host tube respectively and when twisted, press against and pinch corresponding insert tubes to produce a snug, secure fasten.

4. The platform system of claim 3, wherein each insert tube has markings at distal ends of each insert tube respectively and each brace member is configured to slide up to but not beyond markings of corresponding insert tubes.

5. The platform system of claim 2, wherein a thumb screw is inserted through each interconnecting joint respectively and when twisted, press against and pinch corresponding insert tubes.

6. The platform system of claim 2, wherein the length of the cart can be further increased by coupling additional host tubes and additional insert tubes to the cart.

7. The platform system of claim 1, wherein the additional brace members and additional insert tubes can be connected to the cart to double the width of the cart.

8. The platform system of claim 1, wherein each upper web is attached to the cart by inserting corresponding second vertical insert tubes protruding from each upper web into corresponding vertical mounts on the cart and wherein by using a combination of the third interconnecting joints, the second vertical insert tubes and the vertical brace members provides numerous upper web configurations including the multiple tiers of over hanging arms.

9. The platform system of claim 1, wherein the second interconnecting joints of the leg levelers comprise "T" joints, wherein the "T" joints are secured to the second horizontal insert tubes and the first vertical insert tubes by thumb screws.

10. The platform system of claim 1, wherein each detachable wheel assemblies comprises a wheel attached to a flange that is bolted to an insert assembly which has a third vertical insert tube that slides into an underside of a corresponding vertical mount, and the third vertical tubes are secured to the corresponding vertical mounts by thumb screws.

11. The platform system of claim 1, wherein, when in use, the indicia-bearing media, retail products and mechanical devices include zip-ties, cords, or clips attached to top portions thereof to suspend and freely swing the indicia-bearing media, retail products, and mechanical devices from the overhanging arms of each upper web.

12. The platform system of claim 1, wherein the horizontal brace members, the first horizontal insert tubes, the vertical mounts, the first vertical insert tubes, the second horizontal insert tubes, the vertical brace members, the second vertical insert tubes, and the overhanging arms are made from at least one of the following materials: aluminum, plastics, composites and/or combinations thereof.

13. The platform system of claim 1, wherein corresponding brace members and corresponding insert tubes are connected by a fastening mechanisms including at least one of thumb screws, snap buttons, and bolts with wing nuts.

* * * * *